United States Patent [19]

Kikuchi

[11] 4,134,666

[45] Jan. 16, 1979

[54] FILM DEVELOPING DEVICE

[75] Inventor: Shuichi Kikuchi, Chiba, Japan

[73] Assignee: Medica Co., Ltd., Tokyo, Japan

[21] Appl. No.: 847,473

[22] Filed: Oct. 31, 1977

[30] Foreign Application Priority Data

Nov. 1, 1976 [JP] Japan ..... 51-130474

[51] Int. Cl.[2] ..... G03D 3/04

[52] U.S. Cl. ..... 354/313; 354/329

[58] Field of Search ..... 354/307, 310, 311, 312, 354/313, 314, 319, 320, 321, 322, 328, 329, 330, 331

[56] References Cited

U.S. PATENT DOCUMENTS 3,724,353 4/1973 Holbert ..... 354/321

4,011,573 3/1977 Braico ..... 354/322

*Primary Examiner*—L. T. Hix

*Assistant Examiner*—Alan Mathews

*Attorney, Agent, or Firm*—Wenderoth, Lind & Ponack

[57] ABSTRACT

A device for developing a photographed film by rolling up and down the film in a liquid developer is provided, which comprises a hollow body opened at the lower end thereof, a rotary shaft axially extending through the hollow body to be slidable thereto and having a length long enough to extend beyond the lower free end of the hollow body, and a disc attached to the lower end of the rotary shaft and adapted to close the lower end of the hollow body when the rotary shaft is raised to a predetermined level.

7 Claims, 6 Drawing Figures

FILM DEVELOPING DEVICE

BACKGROUND OF THE INVENTION

This invention relates to a film developing device of the type which can develop a photographed roll of film by rolling up and down the film repeatedly in turn in a liquid developer and, more particularly, to a device which can develop the film in a light place without exposing the film to light.

In a known film developing device of this type, a cassette or magazine taken out of a camera and containing a photographed roll of film therein is immersed as it is into a developer casing. The photographed roll of film is developed by rotating a spool of the magazine in the clockwise and counterclockwise directions repeatedly in turn for the predetermined number of rotations to roll up and down the film in the developer. However, in the most of the roll films sold in the market, the inner end of the film is connected to the spool of the magazine by an adhesive take only, so that while the film is being developed by rolling up and down the film in the liquid developer, it has been experienced that the adhesive tape be separated from the spool to make it impossible to roll up and down the film any more. Such separation of the adhesive tape has often occured in the developing process of a coloured film which requires a relatively long processing period of time compared with that of a monochrome film. Further, in the known film developing device, the liquid developer is allowed to permeate into the magazine only through a narrow film passage or outlet at the circumference of the magazine. Accordingly, the permeation of the developer into the magazine is relatively slow when the magazine is immersed into the developer, and also the drainage of the developer from the magazine is insufficient when the magazine is taken out of the developer. Thus, the known developing device could not be adapted with satisfaction for developing a coloured roll of film, which requires to successively immerse the film into plural processing liquids without delay.

BRIEF SUMMARY OF THE INVENTION

Accordingly, an object of the present invention is to provide a film developing device which can certainly develop a roll of film in a light place by rolling up and down the film in a developer.

Another object of the present invention is to provide a film developing device suited for developing a coloured film.

A further object of the present invention is to provide a film developing device which allows immediate permeation and drainage of a developer into and out of a space around the film.

According to the present invention, a device for developing a photographed film by rolling up and down the film in a liquid developer comprises a hollow body opened at the lower end thereof, a rotary shaft axially extending through the hollow body to be slidable thereto and having a length long enough to extend beyond the lower free end of the hollow body, and a disc attached to the lower end of the rotary shaft and adapted to close the lower end of the hollow body when the rotary shaft is raised to a predetermined level.

Preferably, the disc has apertures on the upper and lower surfaces thereof, which are communicated with each other by bent passages not to allow light to be penetrated from the aperture on one surface to the other aperture on the other surface.

The rotary shaft may have an annular plate attached thereto above the disc with a space substantially corresponding to a width of the film to be developed, the annular plate having a diameter smaller than that of the hollow body.

Other objects and features of the present invention will become apparent from the following detailed description of preferred embodiments thereof when taken in conjunction with the accompanying drawings, in which

DETAILED DESCRIPTION OF THE INVENTION

Figure 1:
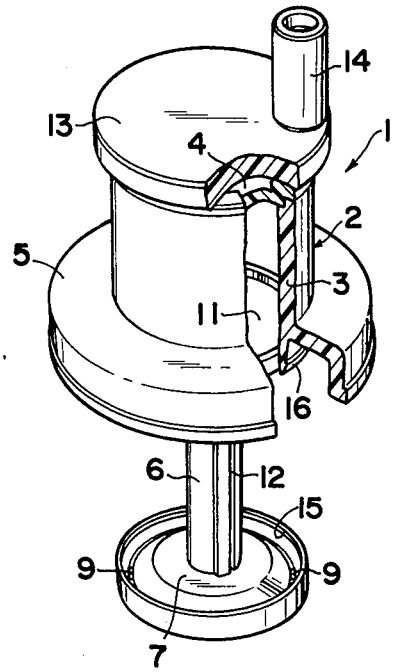
FIG. 1 is a partially sectioned perspective view showing a film developing device according to an embodiment of the present invention.
Figure 2:
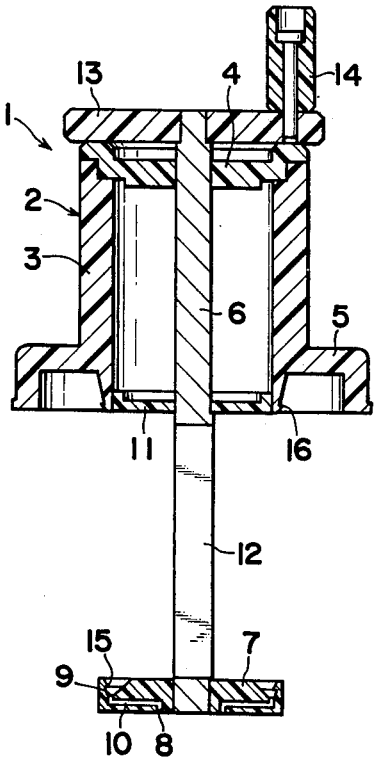
FIG. 2 is a vertical sectional view of the device shown in FIG. 1.

Referring now to a first embodiment of the present invention shown in FIGS. 1 and 2, a film developing device 1 comprises a hollow body 2 having a cylindrical side wall 3, the upper end of which is closed by an integral annular cover plate 4 but the lower end of which is open. The hollow body 2 also has a skirtshaped flange 5 integrally connected to the cylindrical side wall 3. The hollow body 2 is made of material impenetrable to light.

A rotary shaft 6 is provided at the axial center part of the hollow body 2 and slidably extends through the annular cover plate 4. The rotary shaft 6 has a length substantially twice as long as the axial length of the hollow body but may have the length much longer than the twice thereof. Provided at the lower end of the rotary shaft 6 is an end disc 7 having a diameter slightly larger than the inner diameter of the cylindrical side wall 3 so as to close the lower end of the cylindrical side wall 3 when the rotary shaft 6 is raised to a predetermined level. The end disc 7 has small apertures 8 and 9 on the upper and lower surfaces thereof, which are communicated with each other by angled or bent passages 10 so as not to allow any light from the lower surface of the disc 7 to be penetrated to the upper surface thereof. The rotary shaft 6 is also provided at the intermediate portion thereof with an annular plate 11, the diameter of which is slightly smaller than the inner diameter of the cylindrical side wall 3 so as to be inserted into the hollow body 2 when the rotary shaft 6 is raised upwardly. The space between the end disc 7 and annular plate 11 is made to substantially correspond to thw width of a film to be developed. The lower part of the rotary shaft 6 between the end disc 7 and the annular plate 11 is provided with a slit 12 into which an end of the film is inserted and held as described hereinafter.

Also provided at the upper end of the rotary shaft 6 is a rotary disc 13 upon which a rotary knob 14 is eccentrically mounted, so that by rotating the knob 14, the shaft 6 is rotated together with the rotary disc 13.

Preferably, the end disc 7 is provided with an upwardly projecting annular thin flexible flange 15 and the lower open end of the cylindrical side wall 3 is provided with an annular projecting rim 16, wherein the diameter of the flange is made slightly smaller than that of the rim 16. Accordingly, when the rotary shaft 6 is raised upwardly, the upper end of the flange 15 comes to contact with the lower end of the rim 16 and is then snugly engaged therewith by snap action.

Figure 3:
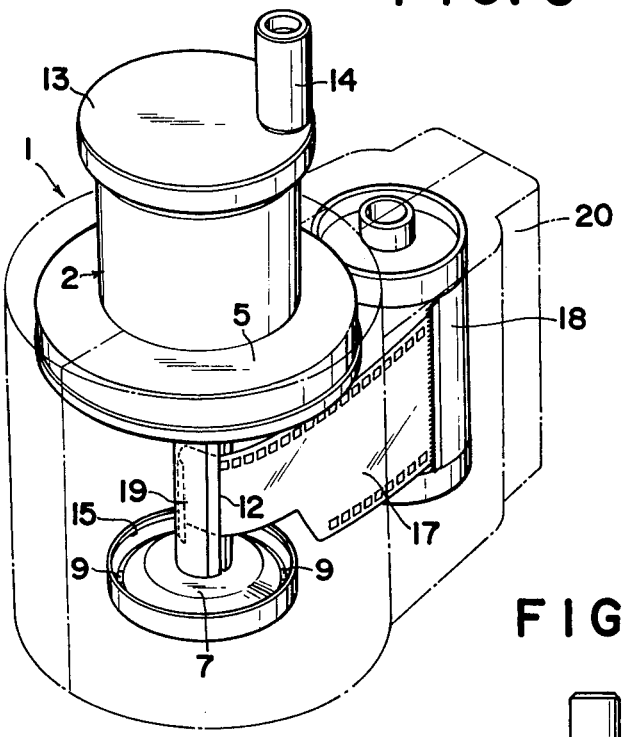
FIG. 3 is a perspective view of the same device showing the manner of winding a photographed film in a magazine to a rotary shaft of the device.
Figure 4:
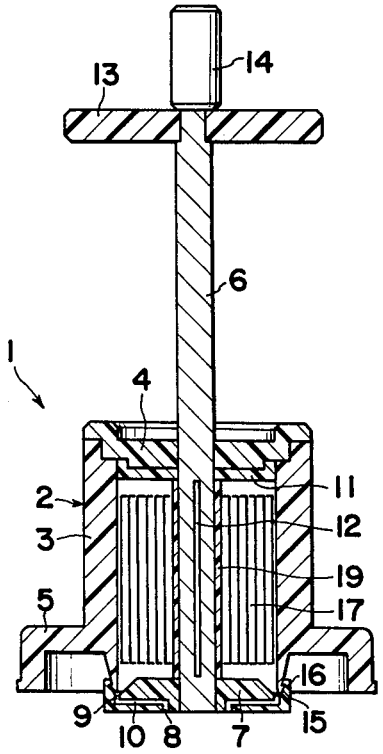
FIG. 4 is a vertical sectional view of the same device showing the rotary shaft raised to a predetermined level after winding the film thereabout.
Figure 5:
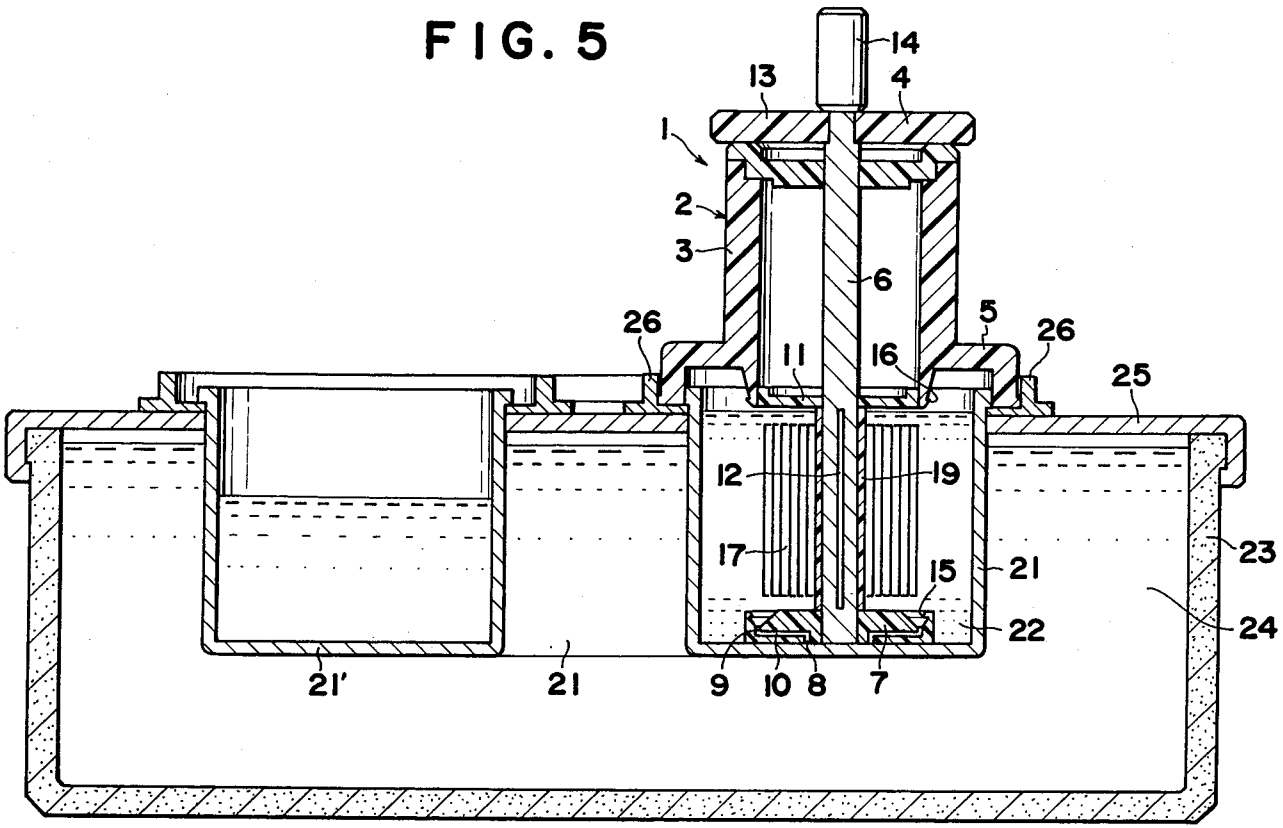
FIG. 5 is a vertical sectional view showing the same device used to develop the film in a developer casing.

Reference is now made to the manner of usage of the present film developing device with reference to FIGS. 3 through 5.

The rotary shaft 6 of the present device takes a lowered position as shown in FIG. 3, in which the lower part of the rotary shaft between the end disc 7 and the annular plate 11 is exposed outside of the hollow body 2. At this position of the rotary shaft 6, an end of the photographed roll film 17 is pull out of the magazine 18 and inserted into the slit 12 in the rotary shaft 6 to pass therethrough. The end of the film 17 extending beyond the slit 12 is bent along the outer surface of the rotary shaft 6 and firmly held thereon by a semi-cylindrical flexible plastic member 19 snugly engaged upon the end of the film 17 and the rotary shaft 6 by snap action. After firmly holding the end of the film 17 to the rotary shaft 6, the magazine 18 as well as the lower part of the rotary shaft 6 are inserted into a known dark bag or a film changer 20 (shown by a chain line) which provide dark place for the film to be wound on the rotary shaft. Then, by holding and rotating the knob 14 on the rotary disc 13 integral with the rotary shaft 6, the photographed film 17 in the magazine 18 is wound to the lower part of the rotary shaft 6. At the final stage of winding of the film, an end portion of the film connected to a spool of the magazine is cut out in the dark bag or film changer 20 and completely wound on the rotary shaft. After winding of the film 17, the rotary shaft 6 is raised to an upper position shown in FIG. 4 wherein the wound film 17 is contained in the hollow body 2 and the lower open end of the cylindrical side wall 3 is closed by the end disc 7 due to snap engagement therebetween, whereby the film 17 is completely enclosed by the hollow body 2 and the end disc 7. Then, the present device 1 is taken out of the dark bag or film changer 20 as shown in FIG. 4 but the film 17 therein cannot be exposed to any external light.

Thereafter, the present device in the state shown in FIG. 4 is placed above a developer casing 21 containing liquid developer 22 therein and secured to temperature controll chamber 23 filled with hot water 24, as shown in FIG. 5. The temperature control chamber 23 is covered with a light-impenetrable covering plate 25 except for the open end portions of the developer casings 22. The covering plate 25 has annular flanges 26 provided to encircle the open end portions of the developer casings 22. The skirt-shaped flange 5 of the present device is snugly engaged with the annular flange 26, whereby the inside of the developer casing 22 is shut out of the exterior thereof so that no light is allowed to enter into the developer casing. After engaging the skirt-shaped flange 5 of the present device with the annular flange 26 of the covering plate 25, the rotary disc 13 as well as the rotary shaft 6 is pushed down, whereby the snap engagement between the end disc 7 and the lower end of the cylindrical side wall 3 is released and the film 17 about the lower part of the rotary shaft 6 is immersed in the developer 22 as shown in FIG. 5. At this position of the film, the rotary disc 13 is rotated by the knob 14 in the clockwise and counterclockwise directions successively in turn for predetermined number of rotations in each direction and for a predetermined time period. Accordingly, the film 17 at the lower part of the rotary shaft 6 is rolled up and down repeatedly in turn by the rotation of the rotary shaft 6, whereby developing process is carried out by the stirring of the liquid developer.

After one developing process is completed in the developer casing 21, the film 17 is again rolled up about the lower part of the rotary shaft 6 and then the rotary shaft 6 is raised to contain the film 17 in the closed space inside of the hollow body 2 above the end disc 7. At this time, any liquid on the end disc or in the closed space is drained through the aperatures 8 and 9 and the bent passges 10 in the disc 7. Thus, after completion of one developing process, the present device take the same state as shown in FIG. 4, which is further placed above the other developer casing 21' and operated in the same manner as set forth above.

Like operation of the present device is carried out repeatedly until the final developing process of the film.

Figure 6:
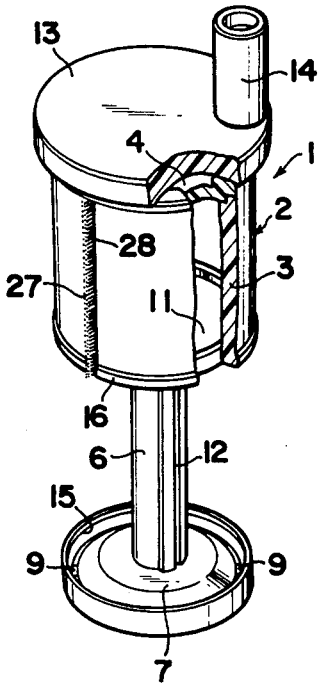
FIG. 6 is a partially sectioned perspective view showing another embodiment of the present device.

Another embodiment of the present invention is shown in FIG. 6. In this embodiment, the hollow body 2 of the film developing device 1 is provided with a vertical slit 27 through the cylindrical side wall 3, which slit 27 extends from the lower free end of the cylindrical side wall to the upper end thereof adjacent to the annular cover plate 4. This slit 27 is covered with light-impenetrable brush 28 attached to both opposite ends of the cylindrical side wall 3 defining the slit 27 therein but allows the film to pass therethrough. The skirt-shaped flange 5 of the device shown in the first embodiment is omitted in the second embodiment. Other features of the second embodiment are substantially same as those of the first embodiment.

In the film developing device of the second embodiment, when the photographed film in the magazine is to be wound on the rotary shaft 6 of the device, the outer end of the film is first secured to the rotary shaft 6 as in the case of the first embodiment. Then, the rotary shaft 6 is raised while the upper edge of the film is inserted into the slit 27 formed through the cylindrical side wall 3 to allow both of the rotary shaft 6 and the film to be raised together. In this state, a tangentially projecting film outlet of the magazine can be partially inserted into the slit 27 covered by the brush 28, so that the winding of the photographed film in the magazine onto the rotary shaft 6 can be carried out without using dark bag or dark film changer.

When the film wound to the rotary shaft 6 is to be developed in a developer casing, it is unnecessary in the second embodiment to make the developer casing and the covering plate thereon impenetrable to light, because the hollow body 2 of the developing device 1 in the second embodiment can be immersed into the liquid developer while the rotary shaft 6 is at the raised position. That is, when the hollow body 2 is immersed into the liquid developer, the developer can immediately enter into the hollow body around the film through the slit 27, so that the developing process can be carried out by rotating the rotary shaft as in the case of the first embodiment.

Although the present invention has been described with reference to preferred embodiments thereof, many modifications and alterations may be made within the spirit of the present invention.

What is claimed is:

1. A device for developing a photographed film by rolling up and down said film in a liquid developer comprising a hollow body opened at the lower end thereof, a rotary shaft axially extending through said hollow body to be slidable thereto and having a length long enough to extend beyond the lower free end of said hollow body, and a disc attached to the lower end of said rotary shaft and adapted to close said lower end of said hollow body when said rotary shaft is raised to a predetermined level.

2. A device as claimed in claim 1, wherein said rotary shaft has an annular plate attached thereto above said disc with a space substantially corresponding to a width of the film to be developed, said annular plate having a diameter smaller than that of said hollow body.

3. A device as claimed in claim 1 further comprising a means for temporarily connecting said disc to the lower end of said hollow body when said rotary shaft is raised to the predetermined level.

4. A device as claimed in claim 1, wherein said disc has apertures on the upper and lower surfaces thereof, said apertures being communicated with each other by bent passages not to allow light to be penetrated from the aperture on one surface to the other aperture on the other surface.

5. A device as claimed in claim 1, wherein said hollow body has a slit extending upwardly from the lower end thereof, said slit being covered with a brush not to allow penetration of light through said slit.

6. A device as claimed in claim 1, further comprising a rotary disc attached to the upper end of said rotary shaft, and a knob mounted upon said rotary disc to be eccentrical relative to said rotary shaft.

7. A device as claimed in claim 2, wherein said rotary shaft has a length substantially twice as long as said hollow body and a slit for engaging the end of the film is provided through said rotary shaft between said disc and said annular plate.

* * * * *